US009984697B2

(12) United States Patent
Qi et al.

(10) Patent No.: US 9,984,697 B2
(45) Date of Patent: *May 29, 2018

(54) AUDIO SIGNAL CODING AND DECODING METHOD AND DEVICE

(71) Applicant: Huawei Technologies Co., Ltd., Shenzhen (CN)

(72) Inventors: Fengyan Qi, Shenzhen (CN); Zexin Liu, Beijing (CN); Lei Miao, Beijing (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days. days.

This patent is subject to a terminal disclaimer.

(21) Appl. No.: 14/789,755

(22) Filed: Jul. 1, 2015

(65) Prior Publication Data

US 2015/0302860 A1 Oct. 22, 2015

Related U.S. Application Data

(63) Continuation of application No. 13/532,237, filed on Jun. 25, 2012, now Pat. No. 9,105,263, which is a (Continued)

(30) Foreign Application Priority Data

Jul. 13, 2011 (CN) ..... 2011 1 0196035

(51) Int. Cl.
*G10L 19/00* (2013.01)
*G10L 19/032* (2013.01)
(Continued)

(52) U.S. Cl.
CPC ..... *G10L 19/032* (2013.01); *G10L 19/002* (2013.01); *G10L 19/0204* (2013.01); *G10L 19/028* (2013.01)

(58) Field of Classification Search
CPC ..... G10L 19/00; G10L 19/002; G10L 19/02; G10L 19/0204; G10L 19/0208; G10L 19/167
(Continued)

(56) References Cited

U.S. PATENT DOCUMENTS 5,375,189 A * 12/1994 Tsutsui ..... H04B 1/667 704/205
5,983,172 A 11/1999 Takashima et al.
(Continued)

FOREIGN PATENT DOCUMENTS

CN 1255673 A 6/2000
CN 1475010 A 2/2004
(Continued)

OTHER PUBLICATIONS

"Series G: Transmission Systems and Media, Digital Systems and Neworks; Digital terminal equipments—Coding of analogue signals; Low-complexity, full-band audio coding for high-quality, conversational applications," Recommendation ITU-T G.719, pp. i-50, International Telecommunication Union, Geneva, Switzerland (Jun. 2008).
(Continued)

*Primary Examiner* — Qi Han
(74) *Attorney, Agent, or Firm* — Leydig, Voit & Mayer, Ltd.

(57) ABSTRACT

An audio signal encoding method is provided. The method includes: dividing a frequency band of an audio signal into a plurality of sub-bands, and quantifying a sub-band normalization factor of each sub-band; determining signal bandwidth of bit allocation according to the quantified sub-band normalization factor, or according to the quantified sub-band normalization factor and bit rate information; allocating bits for a sub-band within the determined signal
(Continued)

bandwidth; and coding a spectrum coefficient of the audio signal according to the bits allocated for each sub-band. According to embodiments of the present invention, during coding and decoding, signal bandwidth of bit allocation is determined according to the quantified sub-band normalization factor and bit rate information. In this manner, the determined signal bandwidth is effectively coded and decoded by centralizing the bits, and audio quality is improved.

32 Claims, 6 Drawing Sheets

Related U.S. Application Data continuation of application No. PCT/CN2012/072778, filed on Mar. 22, 2012.

(51) Int. Cl.
*G10L 19/002* (2013.01)
*G10L 19/02* (2013.01)
*G10L 19/028* (2013.01)

(58) Field of Classification Search
USPC ..... 704/500, 501, 200, 201, 229, 230
See application file for complete search history.

(56) References Cited

U.S. PATENT DOCUMENTS

| | | | |
|---|---|---|---|
| 6,098,039 | A | 8/2000 | Nishida |
| 6,327,563 | B1 | 12/2001 | Takagi |
| 6,735,252 | B1 | 5/2004 | Koyata |
| 7,580,893 | B1 | 8/2009 | Suzuki |
| 7,676,043 | B1 | 3/2010 | Tsutsui et al. |
| 2002/0004718 | A1 | 1/2002 | Hasegawa et al. |
| 2002/0103637 | A1 | 8/2002 | Henn et al. |
| 2005/0261892 | A1 | 11/2005 | Makinen et al. |
| 2006/0172862 | A1 | 8/2006 | Badarneh et al. |
| 2006/0265087 | A1 | 11/2006 | Philippe et al. |
| 2007/0016404 | A1 | 1/2007 | Kim et al. |
| 2010/0106493 | A1 | 4/2010 | Zhou et al. |
| 2011/0035212 | A1 | 2/2011 | Briand et al. |
| 2011/0178795 | A1 | 7/2011 | Bayer et al. |
| 2011/0264454 | A1 | 10/2011 | Ullberg et al. |
| 2013/0018660 | A1 | 1/2013 | Qi et al. |
| 2013/0030795 | A1 | 1/2013 | Sung et al. |

FOREIGN PATENT DOCUMENTS

| | | | |
|---|---|---|---|
| CN | 1954365 | A | 4/2007 |
| CN | 101325059 | A | 12/2008 |
| CN | 101939782 | A | 1/2011 |
| CN | 102208188 | A | 10/2011 |
| EP | 1667112 | A1 | 6/2006 |
| EP | 2224432 | B1 | 3/2017 |
| JP | H09153811 | A | 6/1997 |
| JP | H10240297 | A | 9/1998 |
| JP | H11195995 | A | 7/1999 |
| JP | H11234139 | A | 8/1999 |
| JP | 2001267928 | A | 9/2001 |
| JP | 2002023799 | A | 1/2002 |
| JP | 2002189499 | A | 7/2002 |
| JP | 2003280695 | A | 10/2003 |
| JP | 2010538318 | A | 12/2010 |
| KR | 20010021368 | A | 3/2001 |
| KR | 20060022257 | A | 3/2006 |
| KR | 20070009339 | A | 1/2007 |
| KR | 20110110044 | A | 10/2011 |
| WO | WO 2009029035 | A1 | 3/2009 |
| WO | WO 2009029037 | A1 | 3/2009 |
| WO | 2009081568 | A1 | 7/2009 |
| WO | WO 2010003618 | A2 | 1/2010 |
| WO | WO 2010021804 | A1 | 2/2010 |

OTHER PUBLICATIONS

2nd Office Action in corresponding U.S. Appl. No. 13/532,237 (Oct. 16, 2014).
1st Office Action in corresponding U.S. Appl. No. 13/532,237 (Feb. 22, 2013).

* cited by examiner

AUDIO SIGNAL CODING AND DECODING METHOD AND DEVICE

CROSS-REFERENCE TO RELATED APPLICATIONS

This application is a continuation of U.S. patent application Ser. No. 13/532,237, filed on Jun. 25, 2012, which is a continuation of International Application No. PCT/CN2012/072778, filed on Mar. 22, 2012, which claims priority to Chinese Patent Application No. 201110196035.3, filed on Jul. 13, 2011. The afore-mentioned patent applications are hereby incorporated by reference in their entireties.

FIELD OF THE INVENTION

The present invention relates to the field of audio signal coding and decoding technologies, and in particular, to an audio signal coding and decoding method and device.

BACKGROUND OF THE INVENTION

At present, communication transmission has been placing more and more importance on quality of audio. Therefore, it is required that music quality is improved as much as possible during coding and decoding while ensuring the voice quality. Music signals usually carry much more abundant information, so a traditional voice CELP (Code Excited Linear Prediction, code excited linear prediction) coding mode is not suitable for coding the music signals. Generally, a transform coding mode is use to process the music signals in a frequency domain to improve the coding quality of the music signals. However, it is a hot top for research in the field of current audio coding on how to effectively use the limited coding bits to efficiently code information.

The current audio coding technology generally uses FFT (Fast Fourier Transform, fast Fourier transform) or MDCT (Modified Discrete Cosine Transform, modified discrete cosine transform) to transform time domain signals to the frequency domain, and then code the frequency domain signals. A limit number of bits for quantification in the case of a low bit rate fail to quantify all audio signals. Therefore, generally the BWE (Bandwidth Extension, bandwidth extension) technology and the spectrum overlay technology may be used.

At the coding end, first input time domain signals are transformed to the frequency domain, and a sub-band normalization factor, that is, envelop information of a spectrum, is extracted from the frequency domain. The spectrum is normalized by using the quantified sub-band normalization factor to obtain the normalized spectrum information. Finally, bit allocation for each sub-band is determined, and the normalized spectrum is quantified. In this manner, the audio signals are coded into quantified envelop information and normalized spectrum information, and then bit streams are output.

The process at a decoding end is inverse to that at a coding end. During low-rate coding, the coding end is incapable of coding all frequency bands; and at the decoding end, the bandwidth extension technology is required to recover frequency bands that are not coded at the coding end. Meanwhile, a lot of zero frequency points may be produced on the coded sub-band due to limitation of a quantifier, so a noise filling module is needed to improve the performance. Finally, the decoded sub-band normalization factor is applied to a decoded normalization spectrum coefficient to obtain a reconstructed spectrum coefficient, and an inverse transform is performed to output time domain audio signals.

However, during the coding process, a high-frequency harmonic may be allocated with some dispersed bits for coding. However, in this case, the distribution of bits at the time axis is not continuous, and consequently a high-frequency harmonic reconstructed during decoding is not smooth, with interruptions. This produces much noise, causing a poor quality of the reconstructed audio.

SUMMARY OF THE INVENTION

Embodiments of the present invention provide an audio signal coding and decoding method and device, which are capable of improving audio quality.

In one aspect, an audio signal coding method is provided, which includes: dividing a frequency band of an audio signal into a plurality of sub-bands, and quantifying a sub-band normalization factor of each sub-band; determining signal bandwidth of bit allocation according to the quantified sub-band normalization factor, or according to the quantified sub-band normalization factor and bit rate information; allocating bits for a sub-band within the determined signal bandwidth; and coding a spectrum coefficient of the audio signal according to the bits allocated for each sub-band.

In another aspect, an audio signal decoding method is provided, which includes: obtaining a quantified sub-band normalization factor; determining signal bandwidth of bit allocation according to the quantified sub-band normalization factor, or according to the quantified sub-band normalization factor and bit rate information; allocating bits for a sub-band within the determined signal bandwidth; decoding a normalized spectrum according to the bits allocated for each sub-band; performing noise filling and bandwidth extension for the decoded normalized spectrum to obtain a normalized full band spectrum; and obtaining a spectrum coefficient of an audio signal according to the normalized full band spectrum and the sub-band normalization factor.

In still one aspect, an audio signal coding device is provided, which includes: a quantifying unit, configured to divide a frequency band of an audio signal into a plurality of sub-bands, and quantify a sub-band normalization factor of each sub-band; a first determining unit, configured to determine signal bandwidth of bit allocation according to the quantified sub-band normalization factor, or according to the quantified sub-band normalization factor and bit rate information; a first allocating unit, configured to allocate bits for a sub-band within the signal bandwidth determined by the first determining unit; and a coding unit, configured to code a spectrum coefficient of the audio signal according to the bits allocated by the first allocating unit for each sub-band.

In still another aspect, an audio signal decoding device is provided, which includes: an obtaining unit, configured to obtain a quantified sub-band normalization factor; a second determining unit, configured to determine signal bandwidth of bit allocation according to the quantified sub-band normalization factor, or according to the quantified sub-band normalization factor and bit rate information; a second allocating unit, configured to allocate bits for a sub-band within the signal bandwidth determined by the second determining unit; a decoding unit, configured to decode a normalized spectrum according to the bits allocated by the second allocating unit for each sub-band; an extending unit, configured to perform noise filling and bandwidth extension for the normalized spectrum decoded by the decoding unit to obtain a normalized full band spectrum; and a recovering unit, configured to obtain a spectrum coefficient of an audio signal according to the normalized full band spectrum and the sub-band normalization factor.

According to embodiments of the present invention, during coding and decoding, signal bandwidth of bit allocation is determined according to the quantified sub-band normalization factor and bit rate information. In this manner, the determined signal bandwidth is effectively coded and decoded by centralizing the bits, and audio quality is improved.

BRIEF DESCRIPTION OF THE DRAWINGS

To make the technical solutions of the present invention clearer, the accompanying drawings for illustrating various embodiments of the present invention are briefly described below. Apparently, the accompanying drawings are for the exemplary purpose only, and persons of ordinary skills in the art can derive other drawings from such accompanying drawings without any creative effort.

DETAILED DESCRIPTION OF THE EMBODIMENTS

The technical solutions disclosed in embodiments of the present invention are described below with reference to embodiments and accompanying drawings. Evidently, the embodiments are exemplary only. Persons of ordinary skills in the art can derive other embodiments from the embodiments given herein without making any creative effort, and all such embodiments fall within the protection scope of the present invention.

Figure 1:
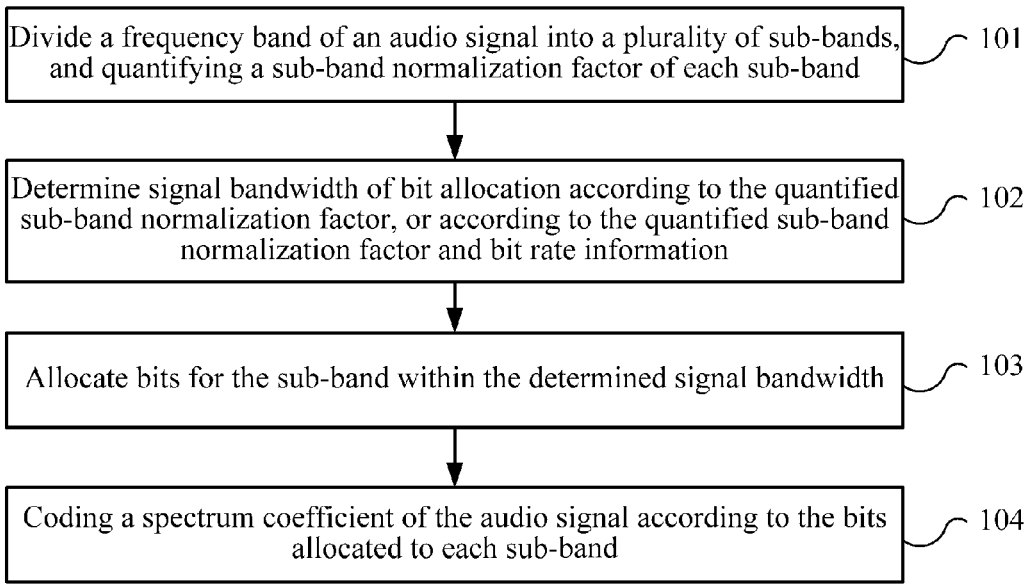
FIG. 1 is a flowchart of an audio signal coding method according to an embodiment of the present invention.

FIG. 1 is a flowchart of an audio signal coding method according to an embodiment of the present invention.

101. Divide a frequency band of an audio signal into a plurality of sub-bands, and quantify a sub-band normalization factor of each sub-band.

The following uses MDCT transform as an example for detailed description. First, the MDCT transform is performed for an input audio signal to obtain a frequency domain coefficient. The MDCT transform may include processes such as windowing, time domain aliasing, and discrete DCT transform.

For example, a time domain signal x(n) is sine-windowed.

$$h(n) = \sin\left[\left(n + \frac{1}{2}\right)\frac{\pi}{2L}\right],\ n = 0, \ldots 2L-1 \tag{1}$$

$L$ indicates the frame length of signal

The obtained windowed signal is:

$$x_w(n) = \begin{cases} h(n)x_{OLD}(n), & n = 0, \ldots, L-1 \\ h(n)x_{OLD}(n-L), & n = L, \ldots, 2L-1 \end{cases} \tag{2}$$

Then an time domain aliasing operation is performed:

$$\tilde{x} = \begin{bmatrix} 0 & 0 & -J_{L/2} & -I_{L/2} \\ I_{L/2} & -J_{L/2} & 0 & 0 \end{bmatrix} x_w \tag{3}$$

$I_{L/2}$ and $J_{L/2}$ respectively indicate two diagonal matrices with an order of L/2:

$$I_{L/2} = \begin{bmatrix} 1 & & 0 \\ & \ddots & \\ 0 & & 1 \end{bmatrix},\ J_{L/2} = \begin{bmatrix} 0 & & 1 \\ & \ddots & \\ 1 & & 0 \end{bmatrix} \tag{4}$$

Discrete DCT transform is performed for the time domain aliased signal to finally obtain an MDCT coefficient of the frequency domain:

$$y(k) = \sum_{n=0}^{L-1} \tilde{x}(n)\cos\left[\left(n + \frac{1}{2}\right)\left(k + \frac{1}{2}\right)\frac{\pi}{L}\right],\quad k = 0, \ldots, L-1 \tag{5}$$

The frequency domain envelope is extracted from the MDCT coefficient and quantified. The entire frequency is divided into multiple sub-bands having different frequency domain resolutions, a normalization factor of each sub-band is extracted, and the sub-band normalization factor is quantified.

For example, as regard an audio signal sampled at a frequency of 32 kHz corresponding to a frequency band having a 16 kHz bandwidth, if the frame length is 20 ms (640 sampling points), sub-band division may be conducted according to the form shown in Table 1.

TABLE 1

| Grouped sub-band division | | | | | | |
|---|---|---|---|---|---|---|
| Group | Number of Coefficients Within the Sub-band | Number of Sub-bands in the Group | Number of Coefficients in the Group | Bandwidth (Hz) | Starting Frequency Point (Hz) | Ending Frequency Point (Hz) |
| I | 8 | 16 | 128 | 3200 | 0 | 3200 |
| II | 16 | 8 | 128 | 3200 | 3200 | 6400 |

TABLE 1-continued

| Grouped sub-band division | | | | | | |
|---|---|---|---|---|---|---|
| Group | Number of Coefficients Within the Sub-band | Number of Sub-bands in the Group | Number of Coefficients in the Group | Bandwidth (Hz) | Starting Frequency Point (Hz) | Ending Frequency Point (Hz) |
| III | 24 | 12 | 288 | 7200 | 6400 | 13600 |
| . . . | . . . | . . . | . . . | . . . | . . . | . . . |

First, the sub-bands are grouped in several groups, and then sub-bands in a group are finely divided. The normalization factor of each sub-band is defined as:

$$Norm(p) = \sqrt{\frac{1}{L_{k=s_p}^{e_p}} \sum y(k)^2}, \quad p = 0, \ldots, P-1 \tag{6}$$

$L_p$ indicates the number of coefficients in a sub-band, $s_p$ indicates a starting point of the sub-band, $e_p$ indicates an ending point of the sub-band, and P indicates the total number of sub-bands.

After the normalization factor is obtained, the fact may be quantified in a log domain to obtain a quantified sub-band normalization factor wnorm.

102. Determine signal bandwidth of bit allocation according to the quantified sub-band normalization factor, or according to the quantified sub-band normalization factor and bit rate information.

Optionally, in an embodiment, the signal bandwidth sfm_limit of the bit allocation may be defined as a part of bandwidth of the audio signal, for example, a part of bandwidth 0-sfm_limit at low frequency or an intermediate part of the bandwidth.

In an example, when the signal bandwidth sfm_limit of the bit allocation is defined, a ratio factor fact may be determined according to bit rate information, where the ratio factor fact is greater than 0 and smaller than or equal to 1. In an embodiment, the smaller the bit rate, the smaller the ratio factor. For example, fact values corresponding to different bit rates may be obtained according to Table 2.

TABLE 2

| Mapping table of the bit rate and the fact value | |
|---|---|
| Bit Rate | Fact Value |
| 24 kbps | 0.8 |
| 32 kbps | 0.9 |
| 48 kbps | 0.95 |
| >64 kbps | 1 |

Alternatively, the fact may also be obtained according to an equation, for example, fact=q×(0.5+bitrate_value/128000), where bitrate_value indicates a value of the bit rate, for example, 24000, and q indicates a correction fact. For example, it may be assumed that q=1. This embodiment of the present invention is not limited to such specific value examples.

The part of the bandwidth is determined according to the ratio factor fact and the quantified sub-band normalization factor wnorm. Spectrum energy within each sub-band may be obtained according to the quantified sub-band normalization factor, the spectrum energy may be accumulated within each sub-band from low frequency to high frequency until the accumulated spectrum energy is greater than the product of a total spectrum energy of all sub-bands multiplied by the ratio factor fact, and bandwidth following the current sub-band is used as the part of the bandwidth.

a. For example, a lowest accumulated frequency point may be set first, and a sum of spectrum energy of sub-bands lower than the frequency point may be calculated. The spectrum energy may be obtained according to the sub-band normalization factor and the following equation:

$$\text{energy_low} = \sum_{p=0}^{q} wnorm(p), \quad q \le P-1 \tag{7}$$

q indicates the sub-band corresponding to the set lowest accumulated frequency point.

Deduction may be made accordingly, and sub-bands are added until a total spectrum energy energy_sum of all sub-bands is calculated.

Based on energy_low, sub-bands are added one by one from low frequency to high frequency to accumulate to obtain the spectrum energy energy_limit, and it is determined whether energy_limit>fact×energy_sum is satisfied. If no, more sub-bands need to be added for a higher accumulated spectrum energy. If yes, the current sub-band is used as the last sub-band of the defined part of the bandwidth. A sequence number sfm_limit of the current sub-band is output for indicating the defined part of the bandwidth, that is, 0-sfm_limit.

In the foregoing example, the ratio factor fact is determined by using the bit rate. In another example, the fact may be determined by using the sub-band normalization factor. For example, a harmonic class or a noise level of the audio signal is first obtained according to the sub-band normalization factor. Generally, the greater the harmonic class of the audio signal, the lower the noise level. The following uses the noise level as an example for detailed description. The noise level may be obtained according to the following equation:

$$\text{noise_lever} = \frac{\sum_{i=0}^{sfm-1} |wnorm(i+1) - wnorm(i)|}{\sum_{i=0}^{sfm-1} wnorm(i)} \tag{8}$$

wnorm indicates the decoded sub-band normalization factor, and sfm indicates the number of sub-bands of the entire frequency band.

When noise_level is high, the fact is great; when noise_level is low, the fact is small. If the harmonic class is used as a parameter, when the harmonic class is great, the fact is small; when the harmonic class is small, the fact is great.

It should be noted that although the foregoing uses the low-frequency bandwidth of 0-sfm_limit, this embodiment of the present invention is not limited to this. As required, the part of the bandwidth may be implemented in another form, for example, a part of bandwidth from a non-zero low frequency point to sfm_limit. Such variations all fall within the scope of the embodiment of the present invention.

103. Allocate bits for a sub-band within the determined signal bandwidth.

Bit allocation may be performed according to a wnorm value of a sub-band within the determined signal bandwidth. The following iteration method may be used: a) find the sub-band corresponding to the maximum wnorm value and allocate a certain number of bits; b) correspondingly reduce the wnorm value of the sub-band; c) repeat steps a) to b) until the bits are allocated completely.

104. Code a spectrum coefficient of the audio signal according to the bits allocated for each sub-band.

For example, the coding coefficient may use the lattice vector quantification solution, or another existing solution for quantifying the MDCT spectrum coefficient.

According to this embodiment of the present invention, during coding and decoding, signal bandwidth of bit allocation is determined according to the quantified sub-band normalization factor and bit rate information. In this manner, the determined signal bandwidth is effectively coded and decoded by centralizing the bits, and audio quality is improved.

For example, when the determined signal bandwidth is 0-sfm_limit of the low frequency part, bits are allocated within the signal bandwidth 0-sfm_limit. The bandwidth sfm_limit for bit allocation is limited so that the selected frequency band is effectively coded by centralizing the bits in the case of a low bit rate and that a more effective bandwidth extension is performed for an uncoded frequency band. This is mainly because if the bit allocation bandwidth is not restricted, a high-frequency harmonic may be allocated with dispersed bits for coding. However, in this case, the distribution of bits at the time axis is not continuous, and consequently the reconstructed high-frequency harmonic is not smooth, with interruptions. If the bit allocation bandwidth is restricted, the dispersed bits are centralized at the low frequency, enabling a better coding of the low-frequency signal; and bandwidth extension is performed for the high-frequency harmonic by using the low-frequency signal, enabling a more continuous high-frequency harmonic signal.

Figure 3:
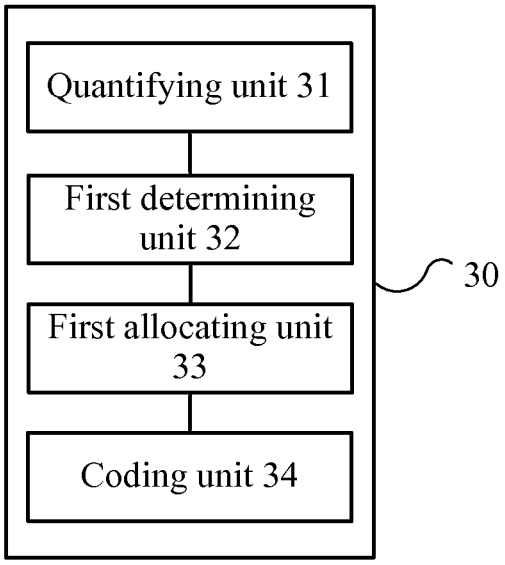
FIG. 3 is a block diagram of an audio signal coding device according to an embodiment of the present invention.

Optionally, in an embodiment, in 103 as shown in FIG. 3, during bit allocation after the signal bandwidth sfm_limit of the bit allocation is determined, the sub-band normalization factor of the sub-band within the bandwidth is firstly adjusted so that a high frequency band is allocated with more bits. The adjustment scale may be self-adaptive to the bit rate. This considers that if a lower frequency band having greater energy within the bandwidth is allocated with more bits, and the bits required for quantification are sufficient, the sub-band normalization factor may be adjusted to increase bits for quantification of high frequency within the frequency band. In this manner, more harmonics may be coded, which is beneficial to bandwidth extension of the higher frequency band. For example, the sub-band normalization factor of an intermediate sub-band of the part of the bandwidth is used as the sub-band normalization factor of each sub-band following the intermediate sub-band. To be specific, the normalization factor of the $(\text{sfm_limit}/2)^{th}$ sub-band may be used as the sub-band normalization factor of each sub-band within the frequency sfm_limit/2-sfm_limit. If sfm_limit/2 is not an integer, it may be rounded up or down. In this case, during bit allocation, the adjusted sub-band normalization factor may be used.

In addition, according to another embodiment of the present invention, in application of the coding and decoding method provided in the embodiment of the present invention, classification of frames of the audio signal may be further considered. In this case, in the embodiment of the present invention, different coding and decoding policies directing to different classifications are able to be used, thereby improving coding and decoding quality of different signals. For example, the audio signal may be classified into types such as Noise (noise), Harmonic (harmonic), and Transient (transient). Generally, a noise-like signal is classified as a Noise mode, with a flat spectrum; a signal changing abruptly in the time domain is classified as a Transient mode, with a flat spectrum; and a signal having a strong harmonic feature is classified as a Harmonic mode, with a greatly changing spectrum and including more information.

Figure 2:
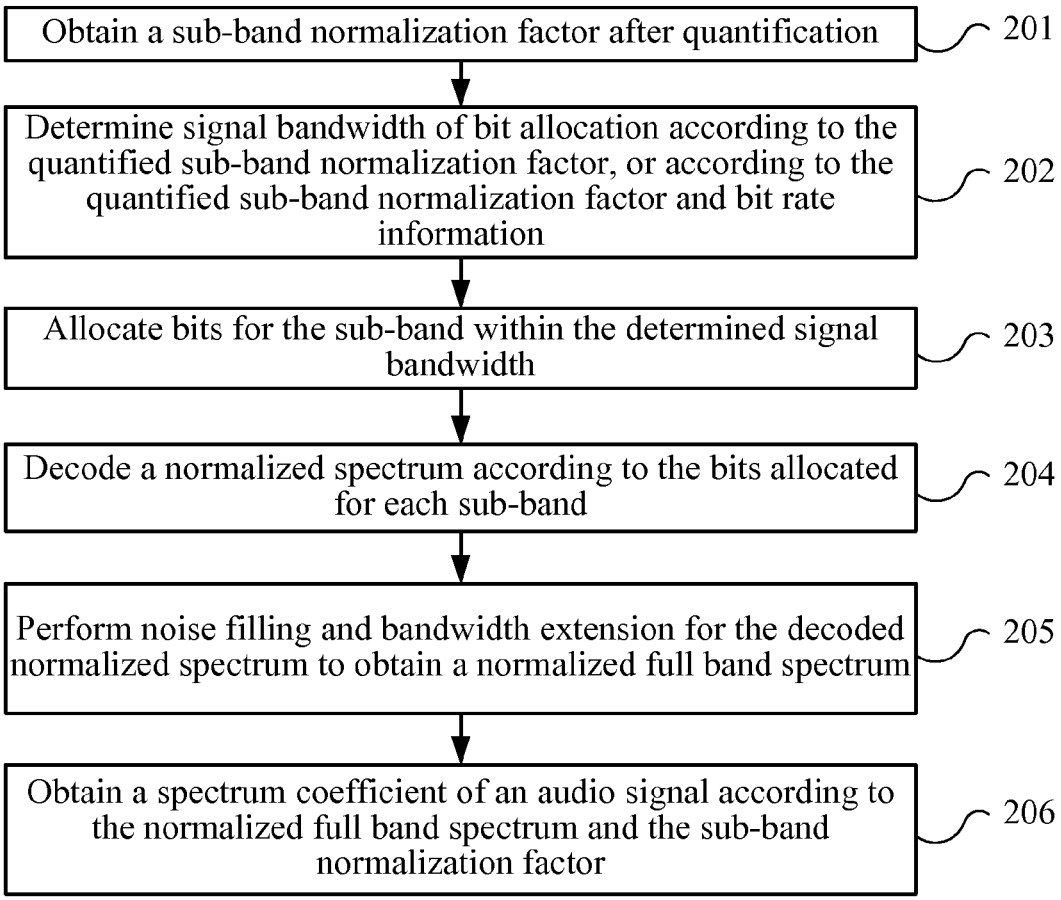
FIG. 2 is a flowchart of an audio signal decoding method according to an embodiment of the present invention.

The following uses the harmonic type and non-harmonic type for detailed description. According to this embodiment of the present invention, before 101 as shown in FIG. 1, it may be determined whether frames of the audio signal belong to the harmonic type or non-harmonic type. If the frames of the audio signal belong to the harmonic type, the method as shown in FIG. 2 is performed continually. Specifically, as regard a frame of the harmonic type, the signal bandwidth of the bit allocation may be defined according to the embodiment illustrated in FIG. 1, that is, defining signal bandwidth of bit allocation of the frame as a part of bandwidth of the frame. As regard a frame of the non-harmonic type, the signal bandwidth of the bit allocation may be defined to a part of bandwidth according to the embodiment illustrated in FIG. 1, or the signal bandwidth of the bit allocation may not be defined, for example, determining the bit allocation bandwidth of the frame as the whole bandwidth of the frame.

The frames of the audio signal may be classified according to a peak-to-average ratio. For example, the peak-to-average ratio of each sub-band among all or part of (high-frequency sub-bands) sub-bands of the frames is obtained. The peak-to-average ratio is calculated from the peak energy of a sub-band divided by the average energy of the sub-band. When the number of sub-bands whose peak-to-average ratio is greater than a first threshold is greater than or equal to a second threshold, it is determined that the frames belong to the harmonic type, when the number of sub-bands whose peak-to-average ratio is greater than the first threshold is smaller than the second threshold, it is determined that the frames belong to the non-harmonic type. The first threshold and the second threshold may be set or changed as required.

However, this embodiment of the present invention is not limited to the example of classification according to the peak-to-average ratio, and classification may be performed according to another parameter.

The bandwidth sfm_limit for bit allocation is limited so that the selected frequency band is effectively coded by centralizing the bits in the case of a low bit rate and that a more effective bandwidth extension is performed for an uncoded frequency band. This is mainly because if the bit allocation bandwidth is not restricted, a high-frequency harmonic may be allocated with dispersed bits for coding. However, in this case, the distribution of bits at the time axis is not continuous, and consequently the reconstructed high-frequency harmonic is not smooth, with interruptions. If the bit allocation bandwidth is restricted, the dispersed bits are centralized at the low frequency, enabling a better coding of the low-frequency signal; and bandwidth extension is performed for the high-frequency harmonic by using the low-frequency signal, enabling a more continuous high-frequency harmonic signal.

The foregoing describes the processing at the coding end, which is an inverse processing for the decoding end. FIG. 2 is a flowchart of an audio signal decoding method according to an embodiment of the present invention.

201. Obtain a quantified sub-band normalization factor.

The quantified sub-band normalization factor may be obtained by decoding a bit stream.

202. Determine signal bandwidth of bit allocation according to the quantified sub-band normalization factor, or according to the quantified sub-band normalization factor and bit rate information. 202 is similar to 102 as shown in FIG. 1, which is therefore not repeatedly described.

203. Allocate bits for a sub-band within the determined signal bandwidth. 203 is similar to 103 as shown in FIG. 1, which is therefore not repeatedly described.

204. Decode a normalized spectrum according to the bits allocated for each sub-band.

205. Perform noise filling and bandwidth extension for the decoded normalized spectrum to obtain a normalized full band spectrum.

206. Obtain a spectrum coefficient of an audio signal according to the normalized full band spectrum and the sub-band normalization factor.

For example, the spectrum coefficient of the audio signal is recovered and obtained by multiplying the normalization spectrum of each sub-band by the sub-band normalization factor of the sub-band.

According to this embodiment of the present invention, during coding and decoding, signal bandwidth of bit allocation is determined according to the quantified sub-band normalization factor and bit rate information. In this manner, the determined signal bandwidth is effectively coded and decoded by centralizing the bits, and audio quality is improved.

In this embodiment, the noise filling and the bandwidth extension described in step 205 are not limited in term of sequence. To be specific, the noise filling may be performed before the bandwidth extension; or the bandwidth extension may be performed before the noise filling. In addition, according to this embodiment, the bandwidth extension may be performed for a part of a frequency band while the noise filling may be performed for the other part of the frequency band simultaneously. Such variations all fall within the scope of this embodiment of the present invention.

Many of zero frequency points may be produced due to limitation of the quantifier during sub-band coding. Generally, some noise may be filled to ensure that the reconstructed audio signal sounds more natural.

If the noise filling is performed first, the bandwidth extension may be performed for the normalized spectrum after the noise filling to obtain a normalized full band spectrum. For example, a first frequency band may be determined according to bit allocation of a current frame and N frames previous to the current frame, and used as a frequency band to copy (copy). N is a positive integer. It is generally desired that multiple continuous sub-bands having allocated bits are selected as a range of the first frequency band. Then, a spectrum coefficient of a high frequency band is obtained according to a spectrum coefficient of the first frequency band.

Using the case where N=1 as an example, optionally, in an embodiment, correlation between a bit allocated for the current frame and bits allocated for the previous N frames may be obtained, and the first frequency band may be determined according to the obtained correlation. For example, assume that the bit allocated to the current frame is R_current, the bit allocated to a previous frame is R_previous, and correlation R_correlation may be obtained by multiplying R_current by R_previous.

After the correlation is obtained, a first sub-band meeting R_correlation≠0 is searched from the highest frequency band having allocated bits last_sfm to the lower ones. This indicates that the current frame and its previous frame both have allocated bits. Assume that the sequence number of the sub-band is top_band.

In an embodiment, the obtained top_band may be used as an upper limit of the first frequency band, top_band/2 may be used as a lower limit of the first frequency band. If the difference between the lower limit of the first frequency band of the previous frame and the lower limit of the first frequency band of the current frame is less than 1 kHz, the lower limit of the first frequency band of the previous frame may be used as the lower limit of the first frequency band of the current frame. This is to ensure continuity of the first frequency band for bandwidth extension and thereby ensure a continuous high frequency spectrum after the bandwidth extension. R_current of the current frame is cached and used as R_previous of a next frame. If top_limit/2 is not an integer, it may be rounded up or down.

During bandwidth extension, the spectrum coefficient of the first frequency band top_band/2-top_band is copied to the high frequency band last_sfm-high_sfm.

The foregoing describes an example of performing the noise filling first. This embodiment of the present invention is not limited thereto. To be specific, the bandwidth extension may be performed first, and then background noise may be filled on the extended full frequency band. The method for noise filling may be similar to the foregoing example.

In addition, as regard the high frequency band, for example, the foregoing-described range of last_sfm-high_sfm, the filled background noise within the frequency band range last_sfm-high_sfm may be further adjusted by using the noise_level value estimated by the decoding end. For the method for calculating noise_level, refer to equation (8). noise_level is obtained by using the decoded sub-band normalization factor, for differentiating the intensity level of the filled noise. Therefore, the coding bits do not need to be transmitted.

The background noise within the high frequency band may be adjusted by using the obtained noise level according to the following method:

$$\tilde{y}(k)=((1-\text{noise_level})*\hat{y}_{norm}(k)+\text{noise_level}*\text{noise_}CB(k))*w\text{norm} \quad (9)$$

$\hat{y}_{norm}(k)$ indicates the decoded normalization factor and noise_CB(k) indicates a noise codebook.

In this manner, the bandwidth extension is performed for a high-frequency harmonic by using a low-frequency signal, enabling the high-frequency harmonic signal to be more continuous, and thereby ensuring the audio quality.

The foregoing describes an example of directly copying the spectrum coefficient of the first frequency band. According to the present invention, the spectrum coefficient of the first frequency bandwidth may be adjusted first, and the bandwidth extension is performed by using the adjusted spectrum coefficient to further enhance the performance of the high frequency band.

A normalization length may be obtained according to spectrum flatness information and a high frequency band signal type, the spectrum coefficient of the first frequency band is normalized according to the obtained normalization length, and the normalized spectrum coefficient of the first frequency band is used as the spectrum coefficient of the high frequency band.

The spectrum flatness information may include: a peak-to-average ratio of each sub-band in the first frequency band, correlation of time domain signals corresponding to the first frequency band, or a zero-crossing rate of time domain signals corresponding to the first frequency band. The following uses the peak-to-average ratio as an example for detailed description. However, this embodiment of the present invention do not imply such a limitation. To be specific, other flatness information may also be used for adjustment. The peak-to-average ratio is calculated from the peak energy of a sub-band divided by the average energy of the sub-band.

Firstly, the peak-to-average ratio of each sub-band of the first frequency band is calculated according to the spectrum coefficient of the first frequency band, it is determined whether the sub-band is a harmonic sub-band according to the value of the peak-to-average ratio and the maximum peak value within the sub-band, the number n_band of harmonic sub-bands is accumulated, and finally a normalization length length_norm_harm is determined self-adaptively according to n_band and a signal type of the high frequency band.

$$\text{length_norm_harm} = \left\lceil \alpha * \left(1 + \frac{\text{n_band}}{M}\right)\right\rceil,$$

where M indicates the number of sub-bands of the first frequency band; $\alpha$ indicates the self-adaptive signal type; in the case of a harmonic signal, $\alpha>1$.

Subsequently, the spectrum coefficient of the first frequency band may be normalized by using the obtained normalization length, and the normalized spectrum coefficient of the first frequency band is used as the coefficient of the high frequency band.

The foregoing describes an example of improving bandwidth extension performance, and other algorithms capable of improving the bandwidth extension performance may also be applied to the present invention.

In addition, similar to the coding end, classification of frames of the audio signal may also be further considered at the decoding end. In this case, in the embodiment of the present invention, different coding and decoding policies directing to different classifications are able to be used, thereby improving coding and decoding quality of different signals. For the method for classification of frames of the audio signal, refer to that of the coding end, which is not detailed here.

Classification information indicating a frame type may be extracted from the bit stream. As regard a frame of the harmonic type, the signal bandwidth of the bit allocation may be defined according to the embodiment illustrated in FIG. 2, that is, defining signal bandwidth of bit allocation of the frame as a part of bandwidth of the frame. As regard a frame of the non-harmonic type, the signal bandwidth of the bit allocation may be defined to a part of bandwidth according to the embodiment illustrated in FIG. 2, or, according to the prior art, the signal bandwidth of the bit allocation may not be defined, for example, determining the bit allocation bandwidth of the frame as the whole bandwidth of the frame.

After the spectrum coefficients of the entire frequency band are obtained, the reconstructed time domain audio signal may be obtained by using frequency inverse transform. Therefore, in this embodiment of the present invention, the harmonic signal quality is able to be improved while the non-harmonic signal quality is maintained.

FIG. 3 is a block diagram of an audio signal coding device according to an embodiment of the present invention. Referring to FIG. 3, an audio signal coding device 30 includes a quantifying unit 31, a first determining unit 32, a first allocating unit 33, and a coding unit 34.

The quantifying unit 31 divides a frequency band of an audio signal into a plurality of sub-bands, and quantifies a sub-band normalization factor of each sub-band. The first determining unit 32 determines signal bandwidth of bit allocation according to the sub-band normalization factor quantified by the quantifying unit 31, or according to the quantified sub-band normalization factor and bit rate information. The first allocating unit 33 allocates bits for a sub-band within the signal bandwidth determined by the first determining unit 32. The coding unit 34 codes a spectrum coefficient of the audio signal according to the bits allocated by the first allocating unit 33 for each sub-band.

According to this embodiment of the present invention, during coding and decoding, signal bandwidth of bit allocation is determined according to the quantified sub-band normalization factor and bit rate information. In this manner, the determined signal bandwidth is effectively coded and decoded by centralizing the bits, and audio quality is improved.

Figure 4:
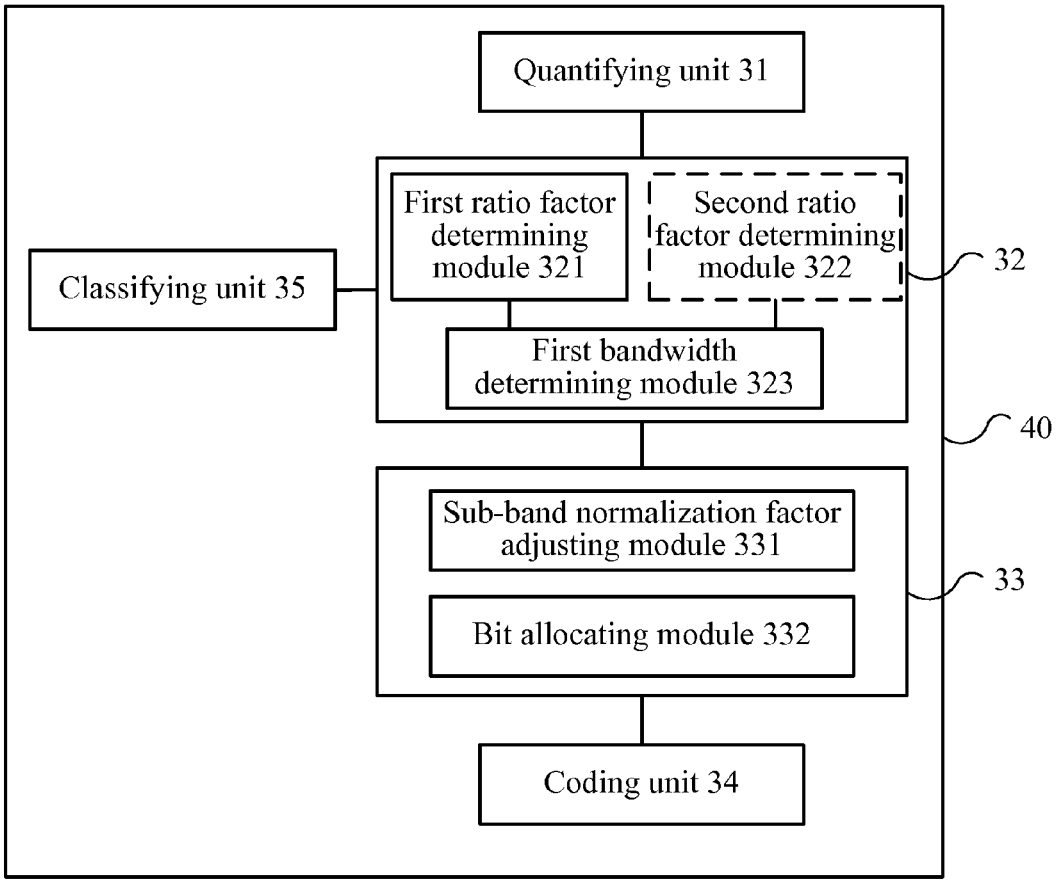
FIG. 4 is a block diagram of an audio signal coding device according to another embodiment of the present invention.

FIG. 4 is a block diagram of an audio signal coding device according to another embodiment of the present invention. In the audio signal coding device 40 as shown in FIG. 4, units or elements similar to those as shown in FIG. 3 are denoted by the same reference numerals.

When determining signal bandwidth of bit allocation, the first determining unit 32 may define the signal bandwidth of the bit allocation to a part of bandwidth of the audio signal. For example, as shown in FIG. 4, the first determining unit 32 may include a first ratio factor determining module 321. The first ratio factor determining module 321 is configured to determine a ratio factor fact according to the bit rate information, where the ratio factor fact is greater than 0 and smaller than or equal to 1. Alternatively, the first determining unit 32 may include a second ratio factor determining module 322 for replacing the first ratio factor determining module 321. The second ratio factor determining module 322 obtains a harmonic class or a noise level of the audio signal according to the sub-band normalization factor, and determines a ratio factor fact according to the harmonic class and the noise level.

In addition, the first determining unit 32 further includes a first bandwidth determining module 323. After obtaining the ratio factor fact, the first bandwidth determining module 323 may determine the part of the bandwidth according to the ratio factor fact and the quantified sub-band normalization factor.

Alternatively, in an embodiment, the first bandwidth determining module 323, when determining the part of the bandwidth, obtains spectrum energy within each sub-band according to the quantified sub-band normalization factor, accumulates the spectrum energy within each sub-band from low frequency to high frequency until the accumulated spectrum energy is greater than the product of a total spectrum energy of all sub-bands multiplied by the ratio factor fact, and uses bandwidth following the current sub-band as the part of the bandwidth.

Considering classification information, the audio signal coding device 40 may further include a classifying unit 35, configured to classify frames of the audio signal. For example, the classifying unit 35 may determine whether the frames of the audio signal belong to a harmonic type or a non-harmonic type; and if the frames of the audio signal belong to the harmonic type, trigger the quantifying unit 31. In an embodiment, the type of the frames may be determined according to a peak-to-average ratio. For example, the classifying unit 35 obtains a peak-to-average radio of each sub-band among all or part of sub-bands of the frames; when the number of sub-bands whose peak-to-average ratio is greater than a first threshold is greater than or equal to a second threshold, determines that the frames belong to the harmonic type; and when the number of sub-bands whose peak-to-average ratio is greater than the first threshold is smaller than the second threshold, determines that the frames belong to the non-harmonic type. In this case, the first determining unit 32, regarding the frames belonging to the harmonic type, defines the signal bandwidth of the bit allocation as the part of the bandwidth of the frames.

Alternatively, in another embodiment, the first allocating unit 33 may include a sub-band normalization factor adjusting module 331 and a bit allocating module 332. The sub-band normalization factor adjusting module 331 adjusts the sub-band normalization factor of the sub-band within the determined signal bandwidth. The bit allocating module 332 allocates the bits according to the adjusted sub-band normalization factor. For example, the first allocating unit 33 may use the sub-band normalization factor of an intermediate sub-band of the part of the bandwidth as a sub-band normalization factor of each sub-band following the intermediate sub-band.

According to this embodiment of the present invention, during coding and decoding, signal bandwidth of bit allocation is determined according to the quantified sub-band normalization factor and bit rate information. In this manner, the determined signal bandwidth is effectively coded and decoded by centralizing the bits, and audio quality is improved.

Figure 5:
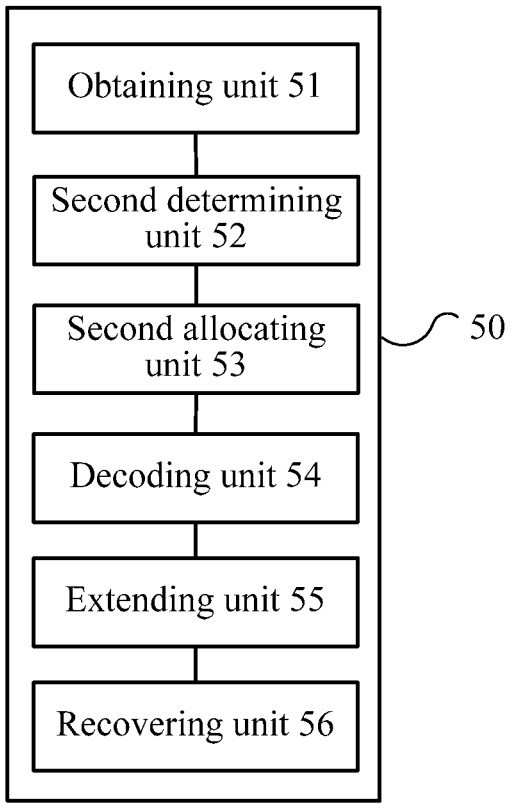
FIG. 5 is a block diagram of an audio signal decoding device according to an embodiment of the present invention.

FIG. 5 is a block diagram of an audio signal decoding device according to an embodiment of the present invention. The audio signal decoding device 50 as shown in FIG. 5 includes an obtaining unit 51, a second determining unit 52, a second allocating unit 53, a decoding unit 54, an extending unit 55, and a recovering unit 56.

The obtaining unit 51 obtains a quantified sub-band normalization factor. The second determining unit 52 determines signal bandwidth of bit allocation according to the quantified sub-band normalization factor obtained by the obtaining unit 51, or according to the quantified sub-band normalization factor and bit rate information. The second allocating unit 53 allocates bits for a sub-band within the signal bandwidth determined by the second determining unit 52. The decoding unit 54 decodes a normalized spectrum according to the bits allocated by the second allocating unit 53 for each sub-band. The extending unit 55 performs noise filling and bandwidth extension for the normalized spectrum decoded by the decoding unit 54 to obtain a normalized full band spectrum. The recovering unit 56 obtains a spectrum coefficient of an audio signal according to the normalized full band spectrum obtained by the extending unit 55 and the sub-band normalization factor.

According to this embodiment of the present invention, during coding and decoding, signal bandwidth of bit allocation is determined according to the quantified sub-band normalization factor and bit rate information. In this manner, the determined signal bandwidth is effectively coded and decoded by centralizing the bits, and audio quality is improved.

Figure 6:
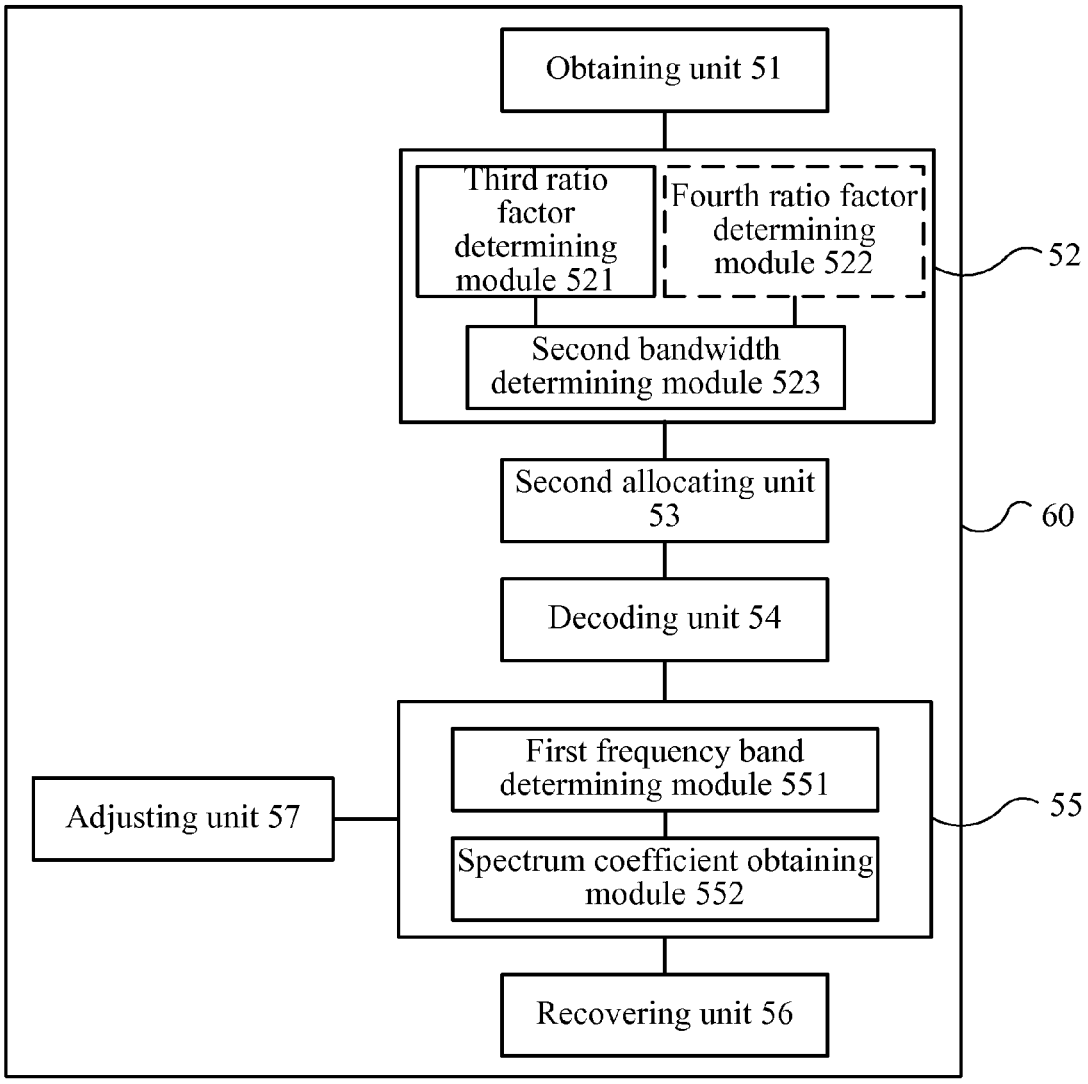
FIG. 6 is a block diagram of an audio signal decoding device according to another embodiment of the present invention.

FIG. 6 is a block diagram of an audio signal decoding device according to another embodiment of the present invention. In the audio signal decoding device 60 as shown in FIG. 6, units or elements similar to those as shown in FIG. 5 are denoted by the same reference numerals.

Similar to the first determining unit 32 as shown in FIG. 4, when determining signal bandwidth of bit allocation, a second determining unit 52 of the audio signal decoding device 60 may define signal bandwidth of bit allocation to a part of bandwidth of an audio signal. For example, the second determining unit 52 may include a third ratio factor determining unit 521, configured to determine a ratio factor fact according to the bit rate information, where the ratio factor fact is greater than 0 and smaller than or equal to 1. Alternatively, the second determining unit 52 may include a fourth ratio factor determining unit 522, configured to obtain a harmonic class or a noise level of the audio signal according to the sub-band normalization factor, and determine a ratio factor fact according to the harmonic class and the noise level.

In addition, the second determining unit 52 further includes a second bandwidth determining module 523. After obtaining the ratio factor fact, the second bandwidth determining module 523 may determine the part of the bandwidth according to the ratio factor fact and the quantified sub-band normalization factor.

Alternatively, in an embodiment, the second bandwidth determining module 523, when determining the part of the bandwidth, obtains spectrum energy within each sub-band according to the quantified sub-band normalization factor, accumulates the spectrum energy within each sub-band from low frequency to high frequency until the accumulated spectrum energy is greater than the product of a total spectrum energy of all sub-bands multiplied by the ratio factor fact, and uses bandwidth following the current sub-band as the part of the bandwidth.

Alternatively, in an embodiment, the extending unit 55 may further include a first frequency band determining module 551 and a spectrum coefficient obtaining module 552. The first frequency band determining module 551 determines a first frequency band according to bit allocation of a current frame and N frames previous to the current frame, where N is a positive integer. The spectrum coefficient obtaining module 552 obtains a spectrum coefficient of a high frequency band according to a spectrum coefficient of the first frequency band. For example, when determining the first frequency band, the first frequency band determining module 551 may obtain correlation between a bit allocated for the current frame and the bits allocated for the previous N frames, and determine the first frequency band according to the obtained correlation.

If background noise needs to be adjusted, the audio signal decoding device 60 may further include an adjusting unit 57, configured to obtain a noise level according to the sub-band normalization factor and adjust background noise within the high frequency band by using the obtained noise level.

Alternatively, in another embodiment, the spectrum coefficient obtaining module 552 may obtain a normalization length according to spectrum flatness information and a high frequency band signal type, normalize the spectrum coefficient of the first frequency band according to the obtained normalization length, and use normalized spectrum coefficient of the first frequency band as the spectrum coefficient of the high frequency band. The spectrum flatness information may include: a peak-to-average ratio of each sub-band in the first frequency band, correlation of time domain signals corresponding to the first frequency band, or a zero-crossing rate of time domain signals corresponding to the first frequency band.

According to this embodiment of the present invention, during coding and decoding, signal bandwidth of bit allocation is determined according to the quantified sub-band normalization factor and bit rate information. In this manner, the determined signal bandwidth is effectively coded and decoded by centralizing the bits, and audio quality is improved.

According to the embodiments of the present invention, a coding and decoding system may include the audio signal coding device and the audio signal decoding device.

Those skilled in the art may understand that the technical solutions of the present invention may be implemented in the form of electronic hardware, computer software, or integration of the hardware and software by combining the exemplary units and algorithm steps described in the embodiments of the present invention. Whether the functions are implemented in hardware or software depends on specific applications and designed limitations of the technical solutions. Those skilled in the art may use different methods to implement the functions in the case of the specific applications. However, this implementation shall not be considered going beyond the scope of the present invention.

A person skilled in the art may clearly understand that for ease and brevity of description, for working processes of the foregoing-described system, apparatus, and units, reference may be made to the corresponding description in the method embodiments, which are not detailed here.

In the exemplary embodiments provided in the present invention, it should be understood that the disclosed system, apparatus, and device, and method may also be implemented in other manners. For example, the apparatus embodiments are merely exemplary ones. For example, the units are divided only by the logic function. In practical implementation, other division manners may also be used. For example, a plurality of units or elements may be combined or may be integrated into a system, or some features may be ignored or not implemented. Further, the illustrated or described inter-coupling, direct coupling, or communicatively connection may be implemented using some interfaces, apparatuses, or units in electronic or mechanical mode, or other manners.

The units used as separate components may be or may not be physically independent of each other. The element illustrated as a unit may be or may not be a physical unit, that is be either located at a position or deployed on a plurality of network units. Part of or all of the units may be selected as required to implement the technical solutions disclosed in the embodiments of the present invention In addition, various function units in embodiments of the present invention may be integrated in a processing unit, or physical independent units; or two or more than two function units may be integrated into a unit.

If the functions are implemented in the form of software functional units and functions as an independent product for sale or use, it may also be stored in a computer readable storage medium. Based on such understandings, the technical solutions or part of the technical solutions disclosed in the present invention that makes contributions to the prior art or part of the technical solutions may be essentially embodied in the form of a software product. The software product may be stored in a storage medium. The software product includes a number of instructions that enable a computer device (a PC, a server, or a network device) to execute the methods provided in the embodiments of the present invention or part of the steps. The storage medium include various mediums capable of storing program code, for example, read only memory (ROM), random access memory (RAM), magnetic disk, or compact disc-read only memory (CD-ROM).

In conclusion, the foregoing are merely exemplary embodiments of the present invention. The scope of the present invention is not limited thereto. Variations or replacements readily apparent to persons skilled in the prior art within the technical scope of the present invention should fall within the protection scope of the present invention. Therefore, the protection scope of the present invention is subject to the appended claims.

What is claimed is:

1. An audio signal encoding method implemented by an audio signal coding device, the method comprising:

dividing a frequency band of an audio signal into a plurality of sub-bands, wherein each sub-band has an index;

obtaining a sub-band envelope of each sub-band of the audio signal;

quantizing the sub-band envelope of each sub-band of the audio signal;

determining an index of a highest sub-band to be allocated bits according to the quantized sub-band envelope and a ratio factor, wherein the ratio factor is depend on bit rate information, and the ratio factor is greater than 0 and less than 1;

allocating at least one bit for a particular sub-band having an index no greater than the index of the highest sub-band to be allocated bits; and encoding a spectrum coefficient of the particular sub-band of the audio signal by using the allocated at least one bit;

outputting the encoded spectrum coefficient from the audio signal coding device using an interface.

2. The method according to claim 1, wherein the index of the highest sub-band to be allocated bits is less than an index of a highest sub-band of the audio signal.

3. The method according to claim 1, wherein determining the index of the highest sub-band to be allocated bits according to the quantized sub-band envelope and a ratio factor comprises:

calculating a sum of the quantized envelopes of at least a part of the plurality of sub-bands of the audio signal; and determining the index of the highest sub-band to be allocated bits according to the calculated sum and the ratio factor.

4. The method according to claim 3, wherein determining the index of the highest sub-band to be allocated bits according to the calculated sum and the ratio factor comprising:

calculating a product of the calculated sum multiplied by the ratio factor;

accumulating the quantized envelopes of the sub-bands whose indexes range $b_{accu}$=[0, b] until the accumulated quantized envelope is greater than the product, wherein b represents the highest index of at least a part of the plurality of sub-bands of the audio signal, wherein an index of the accumulated highest sub-band is the index of the highest sub-band to be allocated bits.

5. The method according to claim 3, wherein the part of the plurality of sub-bands of the audio signal comprises a first 28 sub-bands of the audio signal.

6. The method according to claim 1, wherein the ratio factor is greater than 0.8 and less than 0.9 when the bit rate is 24.4 kbps.

7. The method according to claim 1, wherein the ratio factor is greater than 0.9 and less than 0.95 when the bit rate is 32 kbps.

8. The method according to claim 1, wherein the method is performed when frames of the audio signal belong to a harmonic type.

9. The method according to claim 1, wherein before allocating the set of bits for the sub-band having an index no greater than the index of the highest sub-band to be allocated bits, the method further comprises:

adjusting the quantized envelopes of a part of the sub-bands whose index range $b_{adj}=[0, b_{index}]$, wherein the $b_{index}$ represents the index of the highest sub-band to be allocated bits.

10. The method according to claim 9, wherein the quantized envelopes of the part of the sub-bands whose index range $b=[0, b_{index}]$ are adjusted as following:

$wnorm(b)=wnorm(b_{index}/2),\ b=b_{index}/2+1, \ldots, b_{index}$, wherein the wnorm represents the quantized envelopes.

11. An audio signal encoding method implemented by an audio signal coding device, the method comprising:

dividing a frequency band of an audio signal into a plurality of sub-bands, wherein each sub-band has an index;

obtaining a sub-band envelope of each sub-band of the audio signal;

quantizing the sub-band envelope of each sub-band of the audio signal;

determining an index of a highest sub-band to be allocated bits according to the quantized sub-band envelope, or according to the quantized sub-band envelope and bit rate information;

allocating at least one bit for a particular sub-band having an index no greater than the index of the highest sub-band to be allocated bits, so as to centralize bits for encoding the particular sub-band of the audio signal; and encoding a spectrum coefficient of the particular sub-band of the audio signal by using the allocated at least one bit;

outputting the encoded spectrum coefficient from the audio signal coding device using an interface;

wherein determining the index of the highest sub-band to be allocated bits according to the quantized sub-band envelope and the bit rate information comprises:

initializing a ratio factor according to the bit rate information, wherein the ratio factor is greater than 0 and less than 1; and determining the index of the highest sub-band to be allocated bits according to the quantized sub-band envelope and the initialized ratio factor.

12. An audio signal coding device for encoding an audio signal comprising a processor and a memory, wherein the memory stores an instruction that enables the processor to implement the following operations:

dividing a frequency band of an audio signal into a plurality of sub-bands, wherein each sub-band has an index;

quantizing the sub-band envelope of each sub-band of the audio signal;

determining an index of a highest sub-band to be allocated bits according to the quantized sub-band envelope and a ratio factor, wherein the ratio factor is depend on bit rate information, and the ratio factor is greater than 0 and less than 1;

allocating at least one bit for a particular sub-band having an index no greater than the index of the highest sub-band to be allocated bits; and encoding a spectrum coefficient of the particular sub-band of the audio signal by using the allocated at least one bit; and outputting the encoded spectrum coefficient from the audio signal coding device.

13. The electronic encoder according to claim 12, wherein the index of the highest sub-band to be allocated bits is less than an index of a highest sub-band of the audio signal.

14. The electronic encoder according to claim 12, wherein determining the index of the highest sub-band to be allocated bits according to the quantized sub-band envelope and a ratio factor comprises:

calculating a sum of the quantized envelopes of at least a part of the plurality of sub-bands of the audio signal; and determining the index of the highest sub-band to be allocated bits according to calculated sum and the ratio factor.

15. The electronic encoder according to claim 14, wherein determining the index of the highest sub-band to be allocated bits according to the calculated sum and the ratio factor comprising:

calculating a product of the calculated sum multiplied by the ratio factor;

accumulating the quantized envelopes of the sub-bands whose indexes range $b_{accu}=[0, b]$ until the accumulated quantized envelope is greater than the product, wherein b represents the highest index of at least a part of the plurality of sub-bands of the audio signal, wherein an index of the accumulated highest sub-band is the index of the highest sub-band to be allocated bits.

16. The electronic encoder according to claim 14, wherein the part of the plurality of sub-bands of the audio signal comprises a first 28 sub-bands of the audio signal.

17. The electronic encoder according to claim 14, wherein the ratio factor is greater than 0.8 and less than 0.9 when the bit rate is 24.4 kbps.

18. The electronic encoder according to claim 14, wherein the ratio factor is greater than 0.9 and less than 0.95 when the bit rate is 32 kbps.

19. The electronic encoder according to claim 12, wherein the memory stores an instruction that enables the processor further to implement the following operation:

adjusting the quantized envelopes of a part of the sub-bands whose index range $b=[0, b_{index}]$, wherein the $b_{index}$ represents the index of the highest sub-band to be allocated bits;

wherein the bits are allocated based on the adjusted quantized envelopes.

20. The electronic encoder according to claim 19, wherein the quantized envelopes of the part of the sub-bands whose index range $b=[0, b_{index}]$ are adjusted as following:

$wnorm(b)=wnorm(b_{index}/2),\ b=b_{index}/2+1, \ldots, b_{index}$, wherein the wnorm represents the quantized envelopes.

21. An audio signal coding device for encoding an audio signal comprising a processor and a memory, wherein the memory stores an instruction that enables the processor to implement the following operations:

dividing a frequency band of an audio signal into a plurality of sub-bands, wherein each sub-band has an index;

quantizing the sub-band envelope of each sub-band of the audio signal;

determining an index of a highest sub-band to be allocated bits according to the quantized sub-band envelope, or according to the quantized sub-band envelope and bit rate information;

allocating at least one bit for a particular sub-band having an index no greater than the index of the highest sub-band to be allocated bits;

encoding a spectrum coefficient of the particular sub-band of the audio signal by using the allocated at least one bit; and outputting the encoded spectrum coefficient from the audio signal coding device;

wherein determining index of the highest sub-band to be allocated bits according to the quantized sub-band envelope and the bit rate information comprises:

initializing a ratio factor according to the bit rate information, wherein the ratio factor is greater than 0 and less than 1; and determining the index of the highest sub-band to be allocated bits according to the quantized sub-band envelope and the initialized ratio factor.

22. A non-transitory computer readable storage medium, tangibly embodying computer program code, which, when executed by an audio signal coding device, causes the audio signal coding device to perform a method comprising:

dividing a frequency band of an audio signal into a plurality of sub-bands, wherein each sub-band has an index;

obtaining a sub-band envelope of each sub-band of the audio signal;

quantizing the sub-band envelope of each sub-band of the audio signal;

determining an index of a highest sub-band to be allocated bits according to the quantized sub-band envelope and a ratio factor, wherein the ratio factor is depend on bit rate information, and the ratio factor is greater than 0 and less than 1;

allocating at least one bit for a particular sub-band having an index no greater than the index of the highest sub-band to be allocated bits; and encoding a spectrum coefficient of the particular sub-band of the audio signal by using the allocated at least one bit.

23. The non-transitory computer readable storage medium according to claim 22, wherein the index of the highest sub-band to be allocated bits is less than an index of a highest sub-band of the audio signal.

24. The non-transitory computer readable storage medium according to claim 22, wherein the method is performed when frames of the audio signal belong to a harmonic type.

25. The non-transitory computer readable storage medium according to claim 22, wherein before allocating the set of bits for the sub-band having an index no greater than the index of the highest sub-band to be allocated bits, the method further comprises:

adjusting the quantized envelopes of a part of the sub-bands whose index range $b=[0, b_{index}]$, wherein the $b_{index}$ represents the index of the highest sub-band to be allocated bits.

26. The non-transitory computer readable storage medium according to claim 25, wherein the quantized envelopes of the part of the sub-bands whose index range $b=[0, b_{index}]$ are adjusted as following:

$wnorm(b)=wnorm(b_{index}/2),\ b=b_{index}/2+1, \ldots, b_{index}$, wherein the wnorm represents the quantized envelopes.

27. A non-transitory computer readable storage medium, tangibly embodying computer program code, which, when executed by an audio signal coding device, causes the audio signal coding device to perform a method comprising:

dividing a frequency band of an audio signal into a plurality of sub-bands, wherein each sub-band has an index;

obtaining a sub-band envelope of each sub-band of the audio signal;

quantizing the sub-band envelope of each sub-band of the audio signal;

determining an index of a highest sub-band to be allocated bits according to the quantized sub-band envelope, or according to the quantized sub-band envelope and bit rate information;

allocating at least one bit for a particular sub-band having an index no greater than the index of the highest sub-band to be allocated bits, so as to centralize bits for encoding the particular sub-band of the audio signal; and encoding a spectrum coefficient of the particular sub-band of the audio signal by using the allocated at least one bit;

wherein determining the index of the highest sub-band to be allocated bits according to the quantized sub-band envelope and the bit rate information comprises:

initializing a ratio factor according to the bit rate information, wherein the ratio factor is greater than 0 and less than 1; and determining the index of the highest sub-band to be allocated bits according to the quantized sub-band envelope and the initialized ratio factor.

28. The non-transitory computer readable storage medium according to claim 27, wherein determining the index of the highest sub-band to be allocated bits according to the quantized sub-band envelope and a ratio factor comprises:

calculating a sum of the quantized envelopes of at least a part of the plurality of sub-bands of the audio signal; and determining the index of the highest sub-band to be allocated bits according to the calculated sum and the ratio factor.

29. The non-transitory computer readable storage medium according to claim 28, wherein determining the index of the highest sub-band to be allocated bits according to the calculated sum and the ratio factor comprising:

calculating a product of the calculated sum multiplied by the ratio factor;

accumulating the quantized envelopes of the sub-bands whose indexes range $b_{accu}=[0, b]$ until the accumulated quantized envelope is greater than the product, wherein b represents the highest index of at least a part of the plurality of sub-bands of the audio signal, wherein an index of the accumulated highest sub-band is the index of the highest sub-band to be allocated bits.

30. The non-transitory computer readable storage medium according to claim 28, wherein the part of the plurality of sub-bands of the audio signal comprises a first 28 sub-bands of the audio signal.

31. The non-transitory computer readable storage medium according to claim 28, wherein the ratio factor is greater than 0.8 and less than 0.9 when the bit rate is 24.4 kbps.

32. The non-transitory computer readable storage medium according to claim 28, wherein the ratio factor is greater than 0.9 and less than 0.95 when the bit rate is 32 kbps.

* * * * *